US008641448B2

(12) United States Patent
Lappoehn

(10) Patent No.: US 8,641,448 B2
(45) Date of Patent: Feb. 4, 2014

(54) PLUG-IN CONNECTION HAVING SHIELDING

(75) Inventor: Juergen Lappoehn, Gammelshausen (DE)

(73) Assignee: ERNI Electronics GmbH & Co. KG, Adelberg (DE)

( * ) Notice: Subject to any disclaimer, the term of this patent is extended or adjusted under 35 U.S.C. 154(b) by 40 days.

(21) Appl. No.: 13/394,622

(22) PCT Filed: Sep. 8, 2010

(86) PCT No.: PCT/DE2010/001055
§ 371 (c)(1),
(2), (4) Date: Mar. 29, 2012

(87) PCT Pub. No.: WO2011/029428
PCT Pub. Date: Mar. 17, 2011

(65) Prior Publication Data

US 2012/0202380 A1 Aug. 9, 2012

(30) Foreign Application Priority Data

Sep. 8, 2009 (DE) ..... 10 2009 040 487

(51) Int. Cl.
*H01R 13/648* (2006.01)

(52) U.S. Cl.
USPC ..... 439/607.09; 439/79

(58) Field of Classification Search
USPC ..... 439/79, 108, 607.01–607.09, 607.34, 439/607.54, 701, 751, 901, 943
See application file for complete search history.

(56) References Cited

U.S. PATENT DOCUMENTS

| | | | | |
|---|---|---|---|---|
| 6,146,157 | A | 11/2000 | Lenoir et al. | |
| 6,328,602 | B1 | 12/2001 | Yamasaki et al. | |
| 6,527,587 | B1 * | 3/2003 | Ortega et al. | 439/607.05 |
| 6,607,401 | B1 * | 8/2003 | Weaver et al. | 439/607.09 |
| 6,808,420 | B2 | 10/2004 | Whiteman, Jr. et al. | |
| 6,808,421 | B2 * | 10/2004 | Okada et al. | 439/607.06 |
| 6,899,566 | B2 * | 5/2005 | Kline et al. | 439/607.56 |

(Continued)

FOREIGN PATENT DOCUMENTS

| | | |
|---|---|---|
| DE | 603 16 145 | 5/2008 |
| EP | 0 891 016 | 1/1999 |
| EP | 1 470 618 | 10/2004 |
| WO | WO 03/065511 | 8/2003 |

OTHER PUBLICATIONS

International Search Report of PCT/DE2010/01055, dated Dec. 10, 2010.

(Continued)

*Primary Examiner* — Thanh Tam Le
(74) *Attorney, Agent, or Firm* — Collard & Roe, P.C.

(57) ABSTRACT

The invention relates to a plug-in connection having shielding, in particular a multi-pin, multi-row plug-in connection comprising a male multipoint connector and a female multipoint connector, the plug-in connection comprising signal contacts, which are arranged in a contact pattern of differential pairs and which form a contact group together with an L-shaped shielding element that surrounds the signal contacts, the contact groups being arranged in rows and columns and adjacent contact groups in adjacent columns being offset from each other by a specifiable length dimension in the longitudinal direction of the columns, the plug-in connection being characterized in that the specified length dimension corresponds to approximately half the distance of two adjacent contact groups in a column.

9 Claims, 12 Drawing Sheets

(56) References Cited

U.S. PATENT DOCUMENTS

| | | | | |
|---|---|---|---|---|
| 6,913,490 | B2 * | 7/2005 | Whiteman et al. | 439/607.05 |
| 6,994,569 | B2 * | 2/2006 | Minich et al. | 439/79 |
| 7,604,502 | B2 * | 10/2009 | Pan | 439/607.08 |
| 7,815,468 | B2 * | 10/2010 | Mizukami | 439/607.34 |
| 8,444,435 | B2 * | 5/2013 | Lee et al. | 439/607.07 |
| 2001/0046810 | A1 | 11/2001 | Cohen et al. | |
| 2003/0203665 | A1 | 10/2003 | Ohnishi et al. | |
| 2004/0097112 | A1 | 5/2004 | Minich et al. | |

OTHER PUBLICATIONS

International Preliminary Report on Patentability of PCT/DE2010/01055 dated Mar. 13, 2012 and Written Opinion of the International Searching Authority.

* cited by examiner

PLUG-IN CONNECTION HAVING SHIELDING

CROSS REFERENCE TO RELATED APPLICATIONS

This application is the National Stage of PCT/DE2010/001055 filed on Sep. 8, 2010, which claims priority under 35 U.S.C. §119 of German Application No. 10 2009 040 487.2 filed on Sep. 8, 2009, the disclosure of which is incorporated by reference. The international application under PCT article 21(2) was not published in English.

The invention relates to a plug-in connection with shielding, especially a multi-pin, multi-row plug-in connection consisting of a male multipoint connector and a female multipoint connector, which respectively comprise signal contacts which are arranged in contact patterns of differential pairs and which form a contact group together with an L-shaped shielding element that surrounds said signal contacts, with the contact groups being arranged in rows and columns and adjacent contact groups in adjacent columns being offset from each other by a predeterminable length dimension in the longitudinal direction of the columns.

DESCRIPTION OF THE PRIOR ART

A plug-in connection of this kind is disclosed by DE 603 16 145 T2 for example. In this plug-in connection, adjacent contact groups in adjacent columns are respectively arranged in an offset manner with respect to each other by a predeterminable length dimension in the longitudinal direction of the columns. The signal contacts are enclosed by an L-shaped shielding element which does not completely enclose the signal contacts however. For this reason, the L-shaped shielding elements are respectively arranged in an alternating fashion from column to column twisted by 180° with respect to each other. Furthermore, the signal contacts are arranged in this plug-in connector offset to one another in adjacent columns by a length dimension which substantially corresponds to the distance of the signal contacts in a contact group. This arrangement in conjunction with the L-shaped shielding elements that do not completely shield the signal contacts and their arrangement do not allow any disturbance-free signal transmission in the very high frequency range.

A plug-in connector with shielding is disclosed in US 2001/0046810 A1 and U.S. Pat. No. 6,328,602 B1, with which higher densities and higher speeds can be achieved in combination with simultaneously reduced electromagnetic coupling (crosstalk) between the signal contacts.

According to US 2001/0046810 A1, an electric connector is provided with insertion pieces with shielding in one piece, which pieces are oriented transversely to the shieldings in a second piece. One piece of the connector is made of wafers with shieldings which are positioned between the wafers. The shieldings in one piece have contact sections in order to produce an electrical connection with shieldings in the other piece. A connector is obtained in this way which can be produced easily and has improved shielding characteristics.

In the plug-in connector according to U.S. Pat. No. 6,328,602 B1, the signal contacts and ground contacts are arranged in an offset manner with respect to one another in adjacent columns in order to prevent crosstalk between the signal contacts. The shielding contacts comprise wing-like projections which partly enclose the signal contacts elements. Such an arrangement does not easily enable a densely packed arrangement of the signal and shielding contact elements. Moreover, the signal behavior is not optimal in such a connector.

A plug-in connection with shielding and signal contacts which are arranged in contact patterns of differential pairs and form a respective contact group together with an L-shaped shielding element enclosing the same, with the contact groups being arranged in rows and columns, is further known from EP 1 470 618 B1.

In the electronics industry, rectangular plug-in connections are frequently used for an electric connection between two circuit boards such as a so-called backplane and circuit boards fastened to the same, or also between circuit boards and connecting lines. A male multipoint connector is arranged on a first circuit board for example and a female multipoint connector adapted to the male multipoint connector on a further circuit board. Said further circuit board will then be fastened by means of the female multipoint connector of the plug-in connection to the first circuit board and will be electrically contacted.

The transmission frequency of electrical signals through these connectors can be very high. It is not only necessary to have a balanced impedance of the various contacts within the female multipoint connector and the male multipoint connector order to reduce signal delays and reflections, but also a shielding of the differential contacts. This is realized by an L-shaped shielding as is disclosed by EP 1 470 618 B1.

In order to achieve an optimal data transmission rate, EP 1 470 618 B1 provides a plug connector with signal contacts which are arranged in a contact pattern of differential pairs aligned in rows and columns, with each differential pair enclosing two of the signal contacts which are spaced from one another by a first distance. A ground shielding is connected with each of the differential pairs, with each ground shielding comprising a male multipoint section which extends along one side of the two signal contacts in their associated pair, and with each ground shielding comprising a leg section which extends along one end of an associated differential pair, and with adjacent of the differential pairs being spaced by a second distance which is larger than the first distance. One tip of the male multipoint section of each of the ground shieldings extends over an outer end of each of the signal contacts of its associated differential pair.

High data transmission rates can already be achieved by such a plug-in connection. As a result of the straight arrangement of the contact groups in rows and columns, further miniaturization is not easily possible. In particular, an increase in the data transmission rate is not easily possible. Furthermore, it has proven to be disadvantageous in such connectors that as a result of their filigree configuration they often do not have the required stability which enable the repeated plugging and detaching of the two plug-in elements of male multipoint connector and female multipoint connector in an easy fashion.

The invention is therefore based on the object of further developing a generic plug-in connection with shielding in such a way that it allows even higher data transmission rates on the one hand and simultaneously has a sturdy configuration which also allows repeated plugging and detaching of the plug-in connection.

SUMMARY OF THE INVENTION

This object is achieved by a plug-in connection with shielding of the kind mentioned above in such a way that adjacent contact groups are arranged in adjacent columns offset from one another by a predeterminable length dimension, with the length dimension corresponding approximately to half the distance of two adjacent contact groups in a column. As a result, not only a maximally possible distance is achieved between the contact groups in one column and the contact groups in an adjacent column so that further miniaturization of the signal contacts can be achieved, but it is also possible by an enlargement of the distance of signal contacts arranged in adjacent columns to achieve a further increase in the data transmission rate to 25 gigabits per second or more. It is a further important advantage that as a result of this respectively offset arrangement of adjacent contact groups in adjacent columns intermediate spaces are produced between the contact groups which can be used on the one hand for arranging stabilizing elements in the plug housing and on the other hand also for improving the shielding between adjacent contact columns, as will be explained below in closer detail.

Further advantageous features and configurations and embodiments of the invention are the subject matter of the dependent claims. A highly advantageous embodiment provides that the predeterminable length dimension corresponds approximately to half the distance of two adjacent contact groups in a column. As a result, a maximally possible distance between the contact groups in a column and the contact groups in an adjacent column is achieved.

It is advantageously provided that the contact groups of the female multipoint connector which are arranged in a column are respectively arranged in a wafer. As a result, the plug can be produced by a layered configuration of such wafers in an especially advantageous manner. In order to achieve an optimal shielding effect it is provided that one respective shielding plate is arranged between adjacent wafers. As a result of the offset arrangement of the contact groups in adjacent contact columns it is now possible that contact elements of the shielding plates are arranged in an offset manner and contact with the shielding elements of adjacent contact groups is established thereby. It is advantageously provided in this connection that the shielding plates comprise a plurality of bent tapering contact springs on its sides facing the plug openings, which contact springs engage in recesses which are adjusted thereto and are arranged in adjacent wafers.

Such an arrangement is only enabled by the offset arrangement of the contact groups in adjacent columns. Only this ensures that even in the case of compact and further miniaturized configuration there will not be any contact between the pair of differential contacts and the contact springs of the shielding plates. As a result of the offset arrangement, the contact springs of the shielding plates are as far away as possible from the pairs of differential contacts. It is further advantageously provided for this purpose that the shielding plates are provided with a thinner configuration in the region of the bent tapering contact springs. This improves the spring effect on the one hand and takes the limited overall space into account on the other hand.

In order to enable maintaining a predetermined modular dimension on the plug side on the one hand and a smaller modular dimension on the circuit board side on the other hand where both the male multipoint connectors and also the female multipoint connectors are fixed and contacted by soldered connections or pressed connections or in any other way, an advantageous embodiment provides that the contact elements of the male multipoint connector taper in such a way that the distance of adjacent contact elements on the circuit board side are slightly smaller than the distance of the contact elements on the plug side.

The tapering is preferably realized by stamping the contact elements on the circuit board side. Such a production can also be realized within the scope of mass production.

An especially advantageous configuration provides that reinforcing ribs are arranged in the male multipoint connector housing in the region of the respectively offset contact groups in which a cavity is formed. As a result, such reinforcing ribs are respectively provided on both sides of the contact group columns, which reinforcing ribs are respectively offset by one column width to the left and the right. These reinforcing ribs enable a substantial increase in the stability of the especially sensitive male multipoint connector housing.

BRIEF DESCRIPTION OF THE DRAWINGS

Further advantages and features of the invention are the subject matter of the description below and the illustration of embodiments in the drawings. Features can either be realized individually or in combination.

The drawings show as follows.

DETAILED DESCRIPTION OF THE PREFERRED EMBODIMENTS

Figure 1:
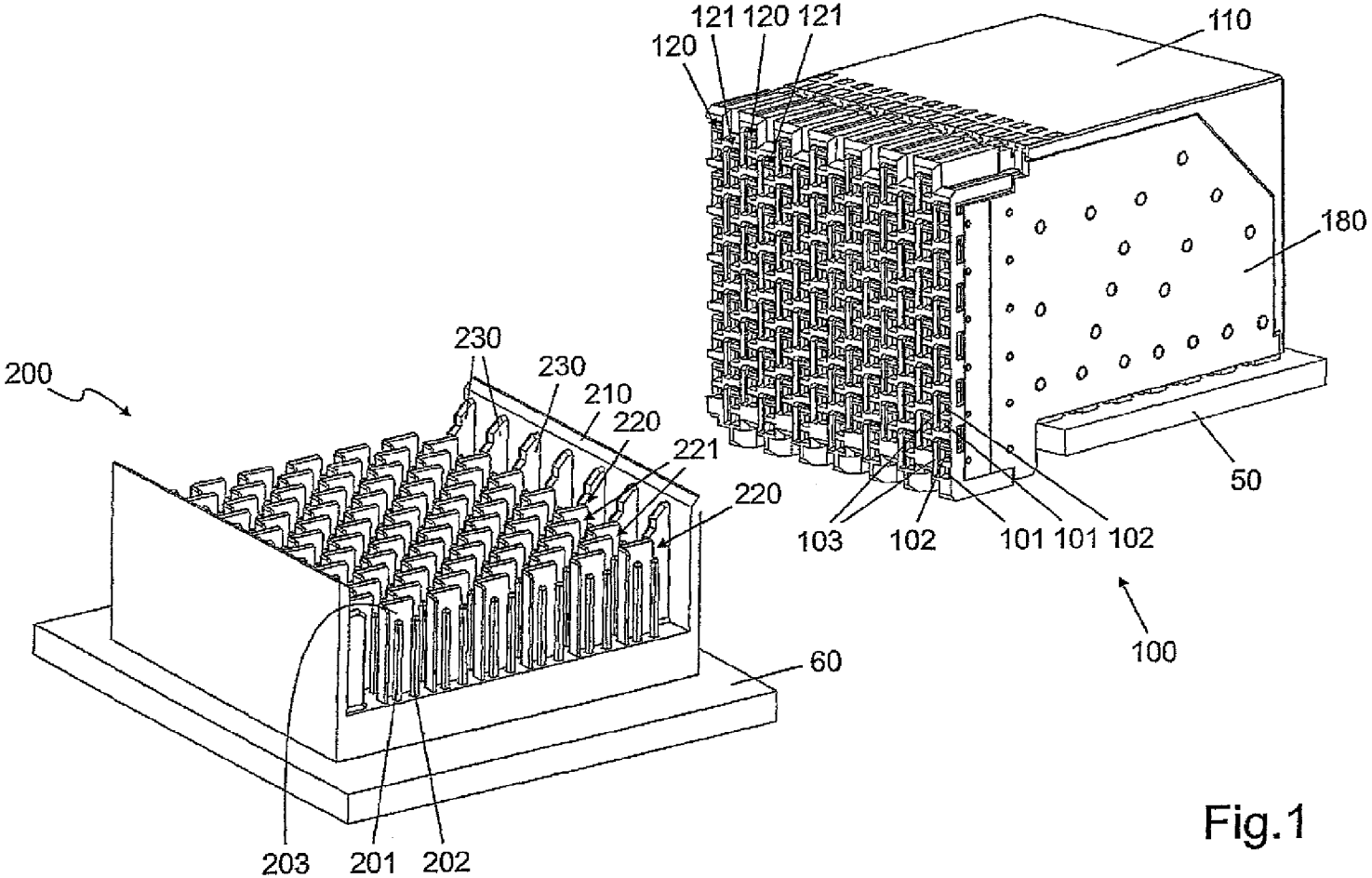
FIG. 1 shows a schematic isometric illustration of a female multipoint connector and a male multipoint connector of a plug-in connection in accordance with the invention.

FIG. 1 shows a female multipoint connector 100 in the right half of the drawing, which female multipoint connector is fixed to and in contact with a circuit board 50 by means of soldered or pressed connections for example. The female multipoint connector comprises a plurality of contact group columns 120 on its front side, which columns are respectively arranged in parallel with respect to each other. Every contact group column 120 comprises a plurality of differential contact pairs 101, 102 which are arranged above one another and which are respectively enclosed by an L-shaped shielding plate 103. Two differential contacts 101, 102 and the associated shielding plate 103 respectively form one contact group. The plug therefore consists of a plurality of contact group columns and contact group rows, with the contact group rows being characterized in such a way that adjacent contact groups in an adjacent contact group column are respectively arranged in an offset manner by a predeterminable length dimension, as will be explained below in closer detail in conjunction with FIG. 2.

The male multipoint connector 200 also comprises contact group columns 220, with a further contact group column 221 being respectively arranged between two contact group columns 220, which contact group column is characterized in that the contact groups are respectively arranged in an offset manner by the same length dimension with respect to the contact groups of the adjacent contact group column 220.

Figure 2:
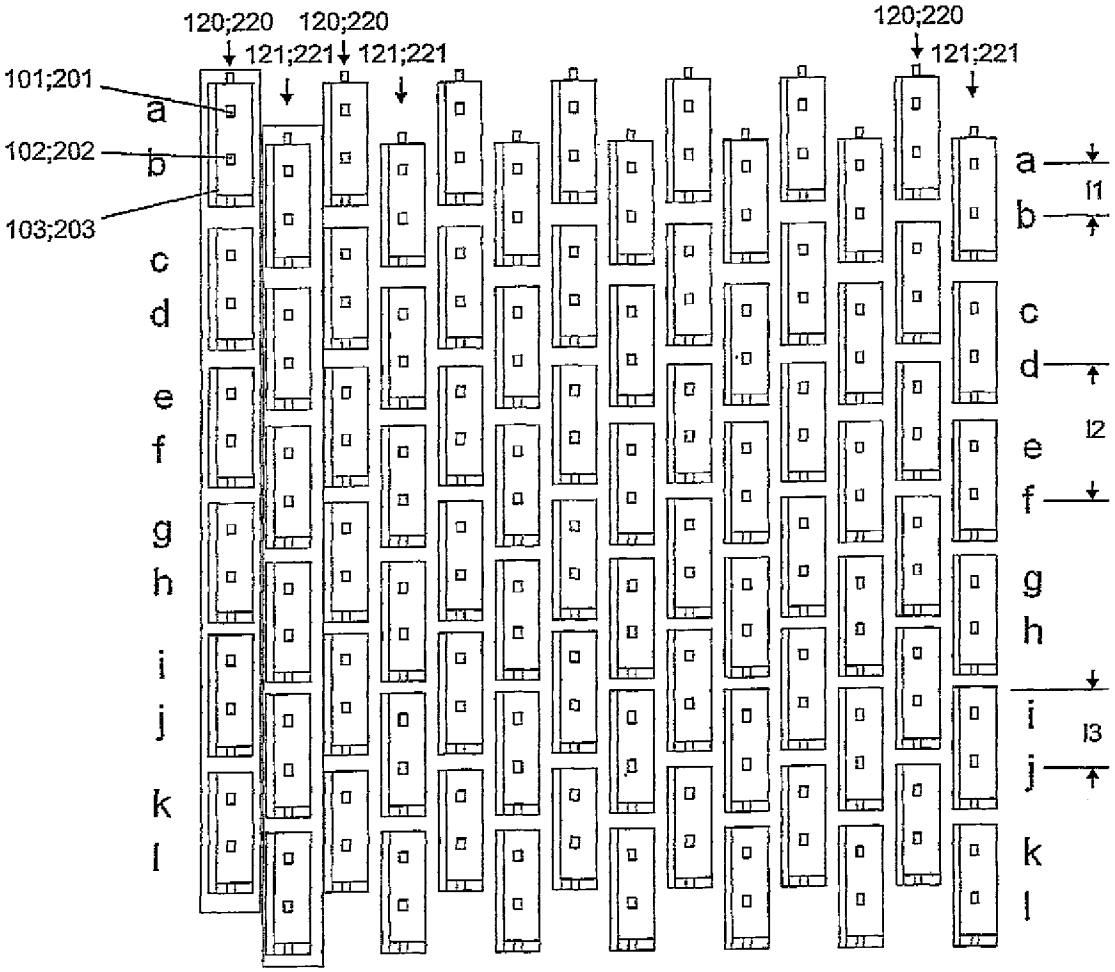
FIG. 2 schematically shows the arrangement of respectively adjacent contact groups.

FIG. 2 shows the respective contact group columns 120 and 220 as well as 121 and 221. The respective contact elements, i.e. contact springs 101 and 102 or contact pins 201 and 202, as well as the shielding elements, i.e. respective L-shaped shielding plates 103 and L-shaped shielding plates 203, are designated for reasons of simplicity from top to bottom in a continuous manner with the letters a), b), c), d) to l). As is shown in FIG. 2, the two differential contact elements 101, 102 and 201, 202 have a distance l1. Adjacent contact groups consisting of the differential contact pairs 101, 102 and 201, 202 and the shielding elements 103 and 203 have a distance l2. The contact groups are respectively arranged in an offset manner with respect to each other in such a way that each contact group in a contact group column 120, 220 respectively has a distance l3 in relation to an adjacent contact group in an adjacent column 121, 221. This distance l3 is preferably half the distance of adjacent contact groups in a column 120, 220 and 121, 221, i.e. l3=l2/2 applies. The largest possible distance between the differential contact pairs is formed in this manner. This arrangement is linked to the relevant advantages as described below.

Figure 3A:
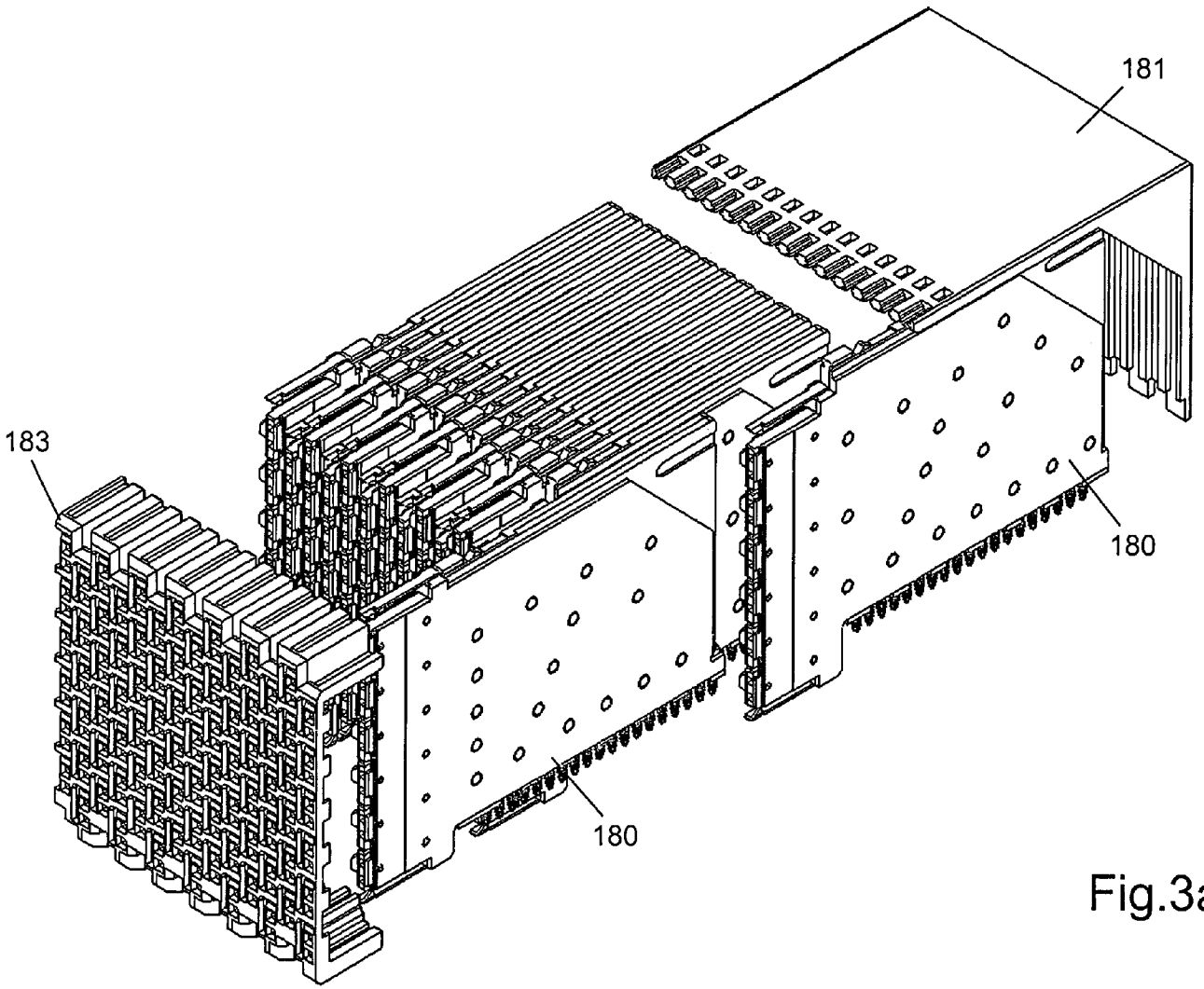
FIGS. 3*a*, 3*b* show an isometric exploded view under different angles of the configuration of a female multipoint connector in accordance with the invention.
Figure 3B:
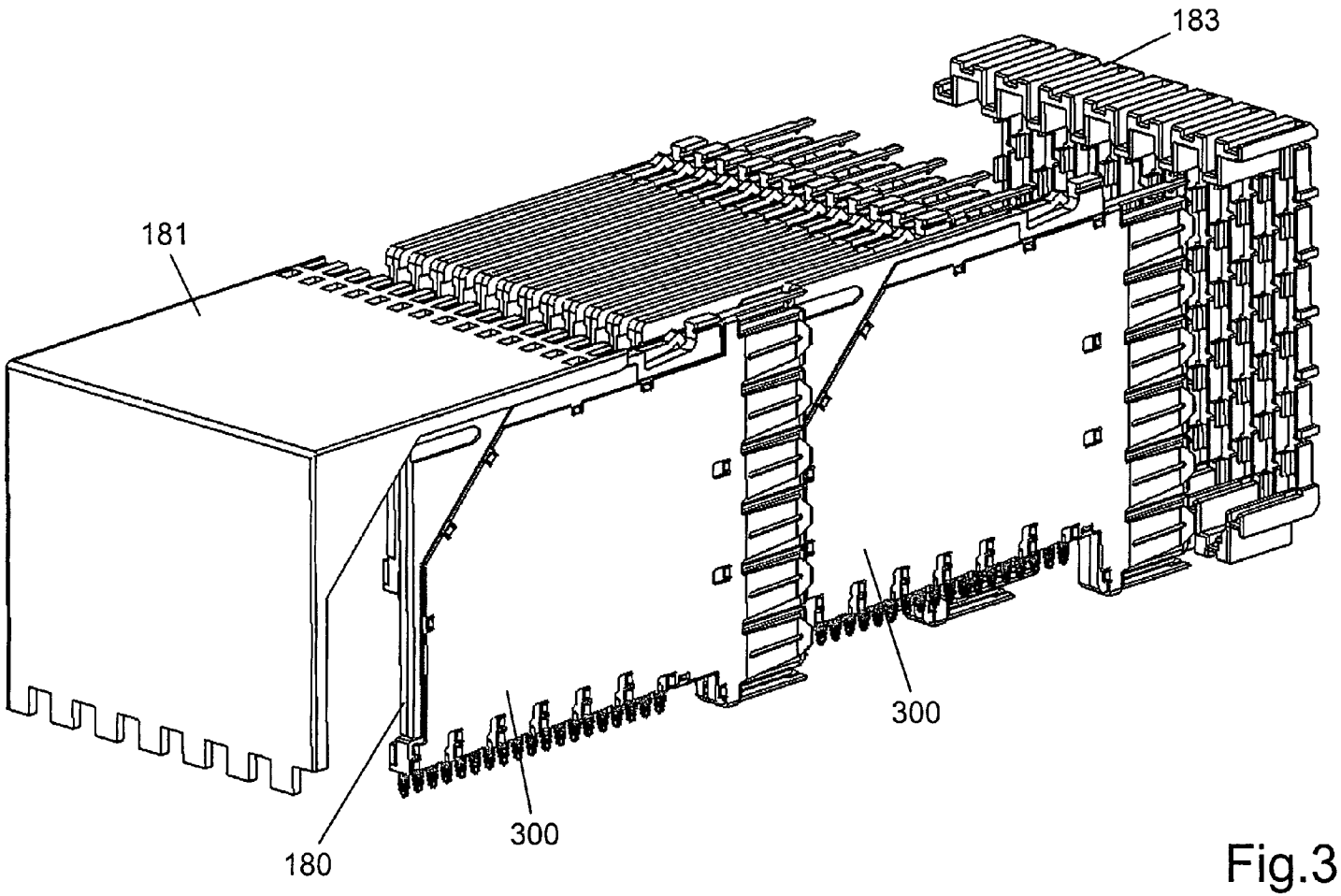
Figure 4:
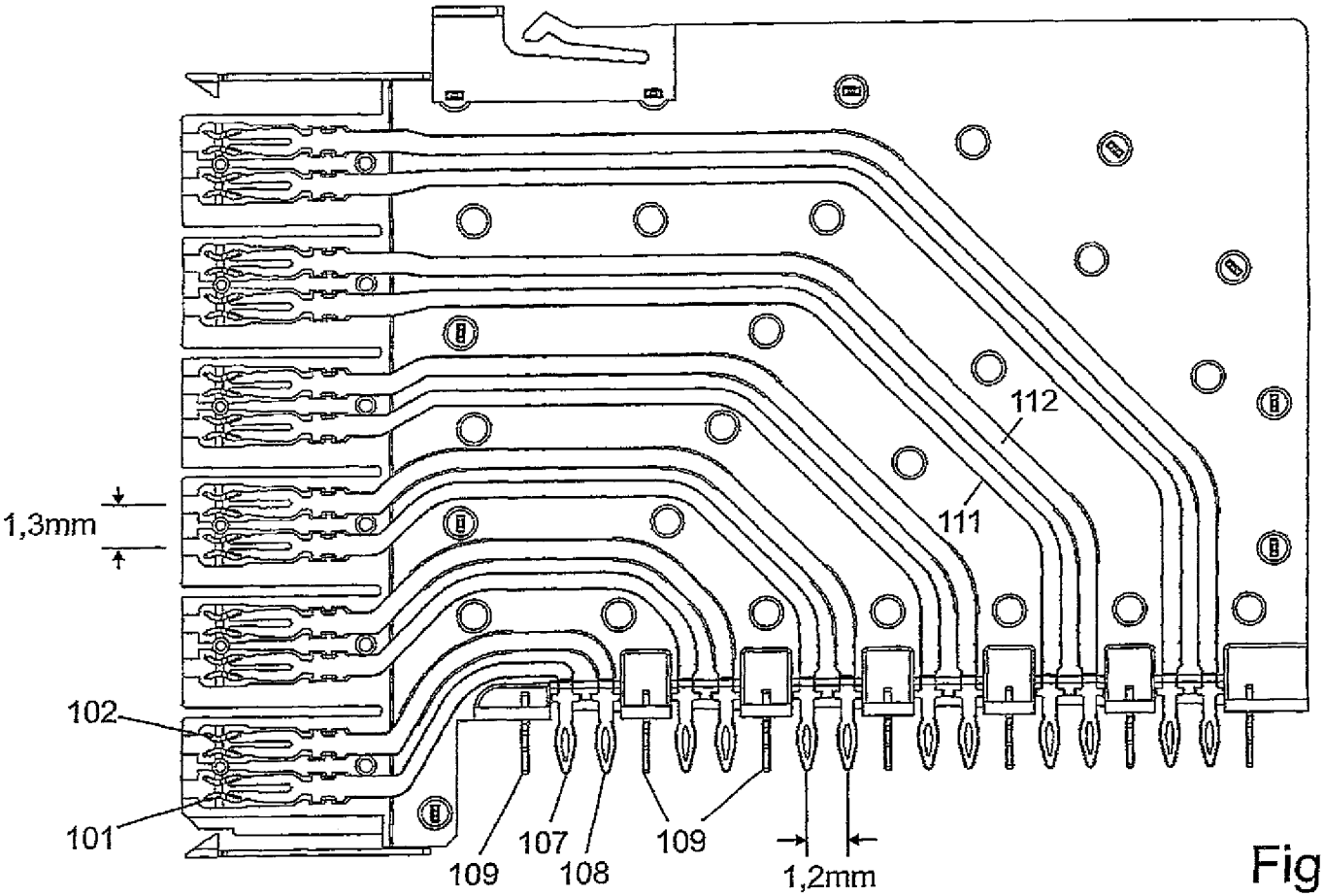
FIG. 4 shows a wafer of a female multipoint connector.

The configuration of a female multipoint connector is shown in FIGS. 3*a*, 3*b* and FIG. 4. Accordingly, the individual contact columns are part of a single wafer 180. The wafers 180 are arranged in a layered manner adjacent to one another, as is shown in FIG. 3*a* and FIG. 3*b*, with shielding plates 300 being arranged between the wafers 180, which will be discussed below in closer detail. The entire configuration will be fixed to a housing element 181 which is also used for stabilizing the female multipoint connector. A cover 183 with openings corresponding to the plug face is provided on the plug side. FIG. 4 shows a single wafer 180. The differential contact pairs 101, 102, which are arranged on the plug side, have a distance of 1.3 mm from one another for example. The differential contact pairs 101, 102 are connected with connection elements 107, 108 on the circuit board side by way of respectively angularly extending lines 111, 112 which extend in the wafer 180, as shown in FIG. 4. It is provided in this respect that the connection elements 107, 108 on the circuit board side have a slightly smaller distance from one another than the connection contacts on the plug side. The distance of the connection elements 107, 108 on the circuit board side is preferably 1.2 mm. Shielding contacts 109 are respectively provided between the signal contact elements 107, 108 on the circuit board side.

Figure 5:
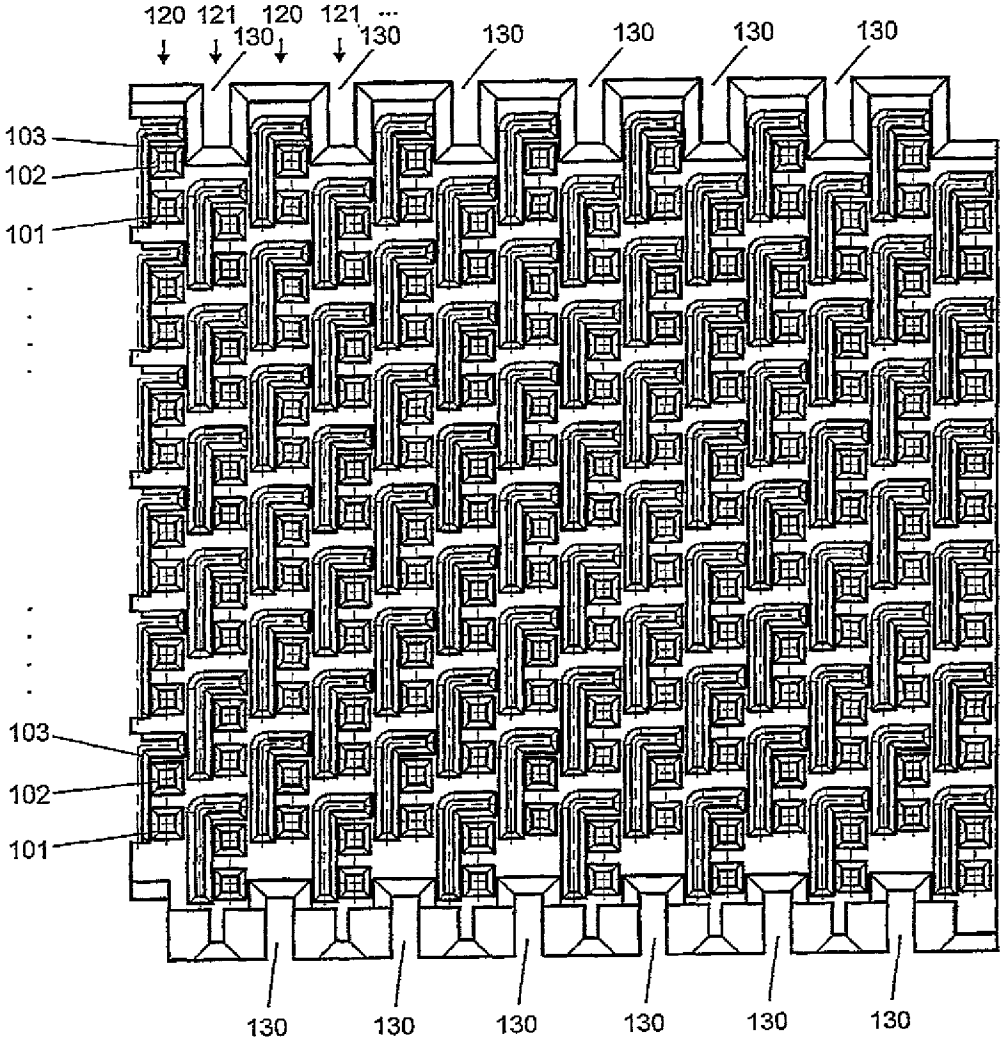
FIG. 5 shows the "plug face" of a female multipoint connector.

The so-called "plug face" is shown in FIG. 5, which shows the front cover 183 from the front. Contact groups consisting of signal elements 101, 102 which are enclosed by L-shaped shielding elements 103 follow in contact groups which are arranged in an offset manner in adjacent columns. This offset configuration leads to a respective cavity 130 between the adjacent columns, in which the reinforcing ribs 230 will engage which are arranged on the male multipoint connector 200. This substantially increases the stability of such a plug-in connection and especially allows repeated plug-in processes.

Figure 6:
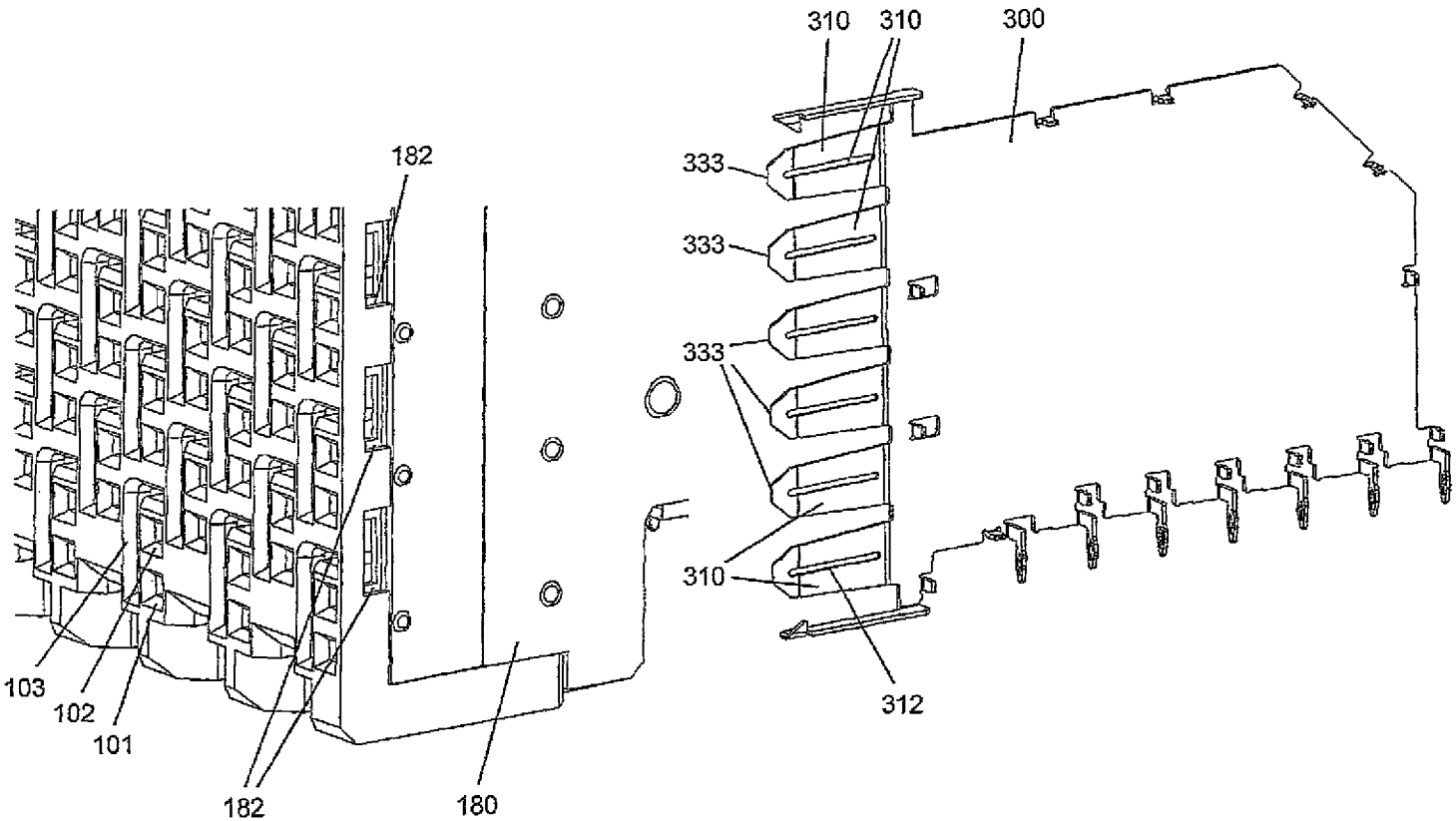
FIG. 6 shows a schematic isometric view of a shielding plate of a female multipoint connector and a part of the female multipoint connector.
Figure 7:
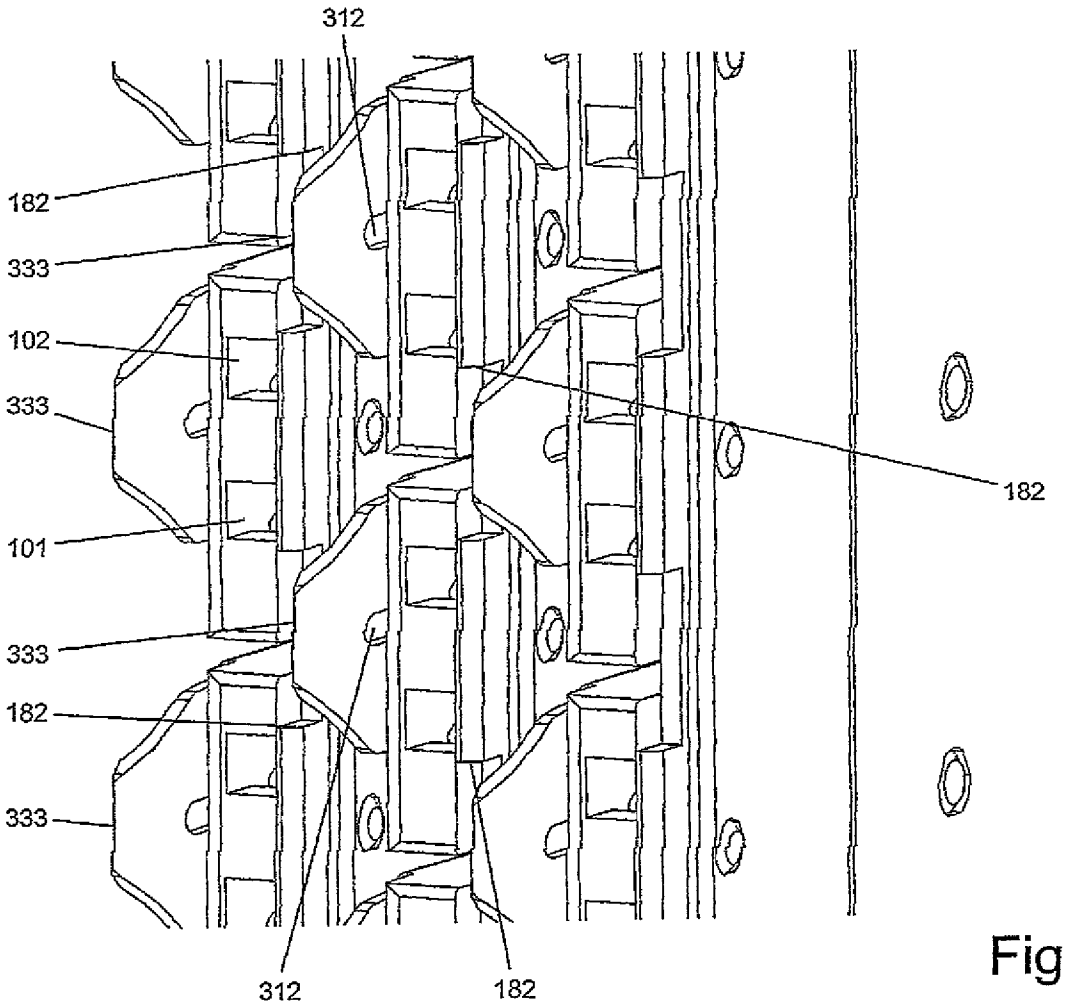
FIG. 7 shows the arrangement of the contact springs of the shielding plates in the mounted state in a female multipoint connector.

The shielding plates 300, which are arranged in a metallically conductive manner, comprise shielding contact springs 310 on their side facing the plug side, which contact springs respectively comprise a gap 312 for increasing the spring effect, as shown in FIG. 6 and FIG. 7. The shielding contact spring elements are curved in their front region and extend in a tapered manner to a point. The "tapered" configuration, i.e. the thinner configuration in the region of the tips 333, can be produced by stamping. The curved tips 333 engage into recesses 182 in the wafers 180 of the female multipoint connector, which recesses are adjusted to said tips. The recesses 182 are arranged in such a way (FIG. 6 and FIG. 7) that the curved tips 333 come to lie in a respectively offset manner in relation to the signal contact openings 101, 102 and come into electrical contact there with the respectively L-shaped shielding plates 203 in the inserted state of female multi point connector and male multipoint connector. As a result of the offset arrangement of the contact groups, the farthest possible distance between the shielding elements and the differential contact pairs is realized in this way and data transmission rates of 25 gigabits per second or more can only be achieved in this way.

Figure 8:
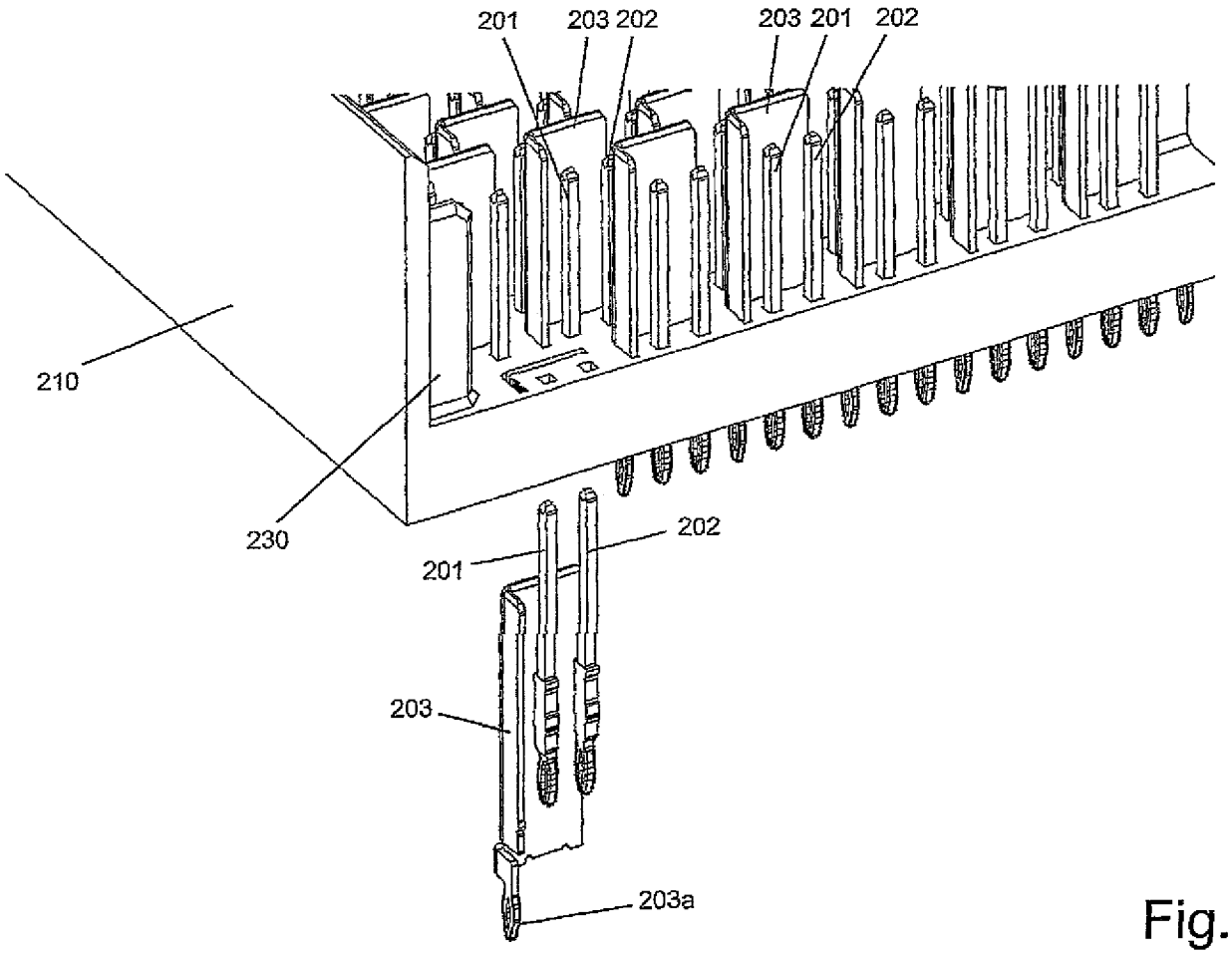
FIG. 8 shows an isometric view of a male multipoint connector, partly in an exploded view.
Figure 9:
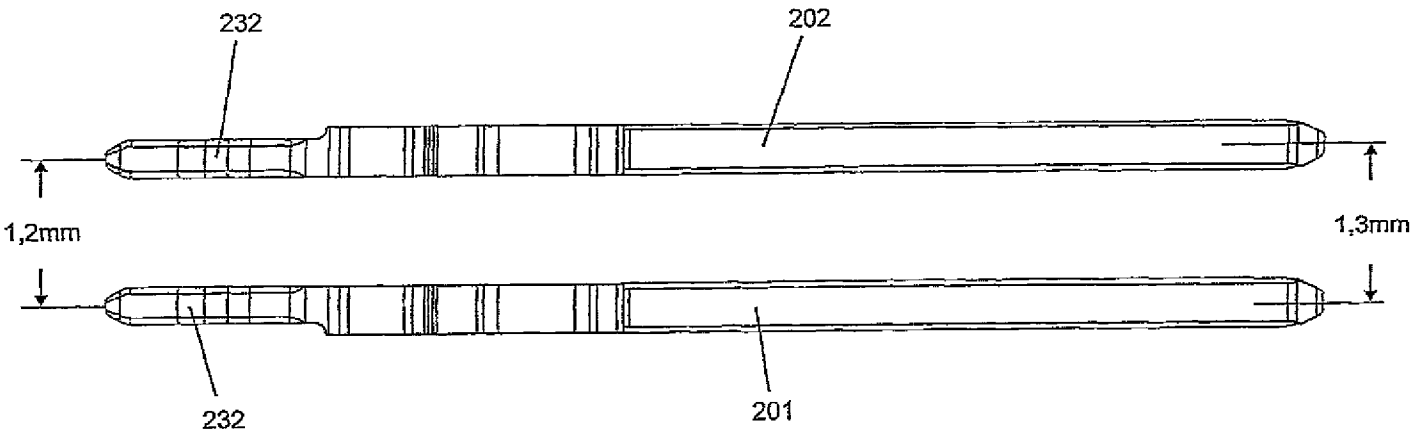
FIG. 9 shows the contacts of the pairs of differential contacts of the male multipoint connector.

The configuration of the male multi point connector will briefly be explained below in connection with FIG. 8. The differential contact pairs 201, 202 and the L-shaped shielding elements 203 which enclose the former are arranged in the housing 210 of the male multipoint connector. It is provided that the differential contact elements have a larger distance of 1.3 mm for example on the plug side than on the circuit board side where the distance is 1.2 mm for example. This is realized in such a way that punched-off portions 232, 233 are provided on the contact elements 201, 202 (FIG. 9). A higher density of the contact elements on the circuit board is achieved thereby.

Figure 10:
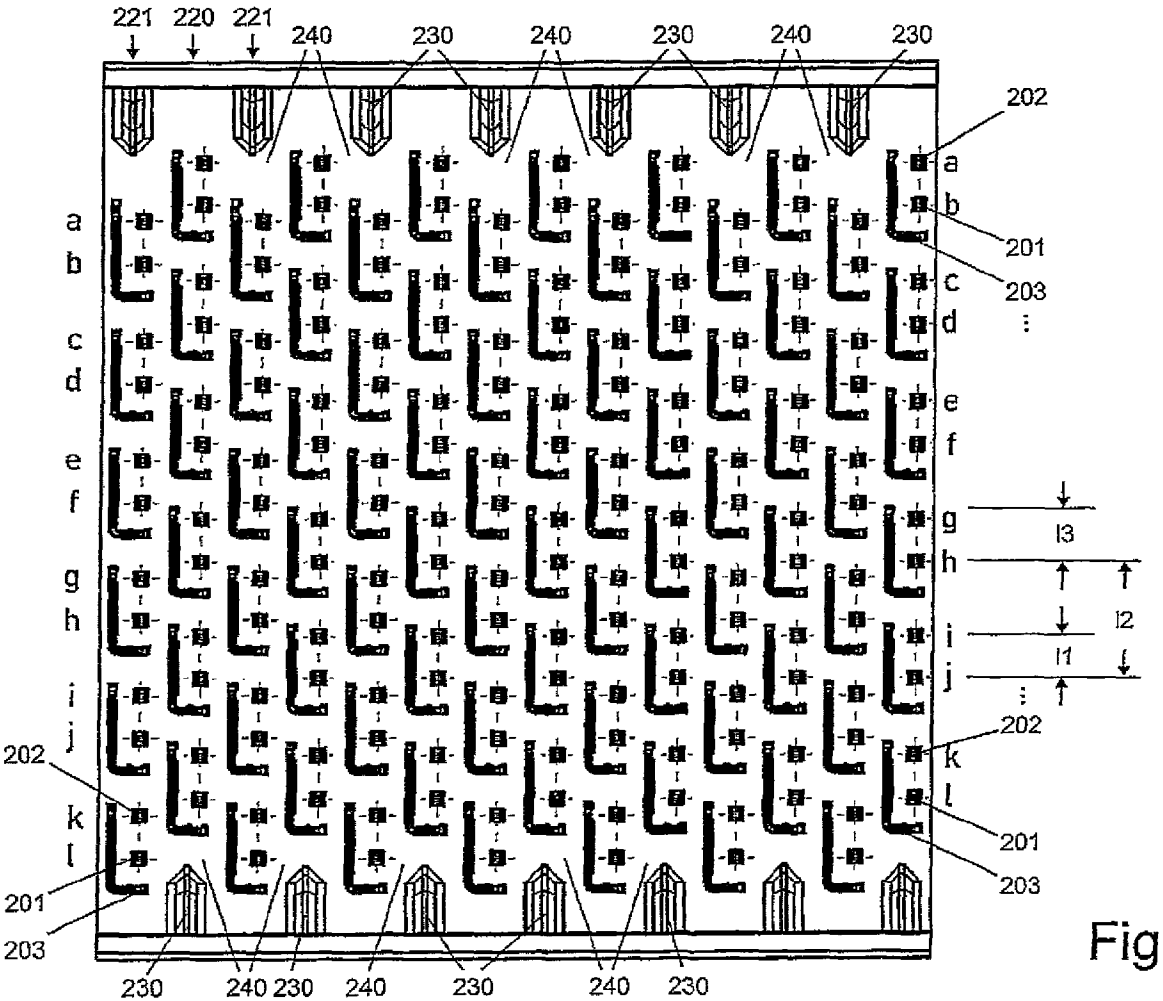
FIG. 10 shows a top view of a male multipoint connector.

FIG. 10 shows the male multipoint connector in a top view. Differential contact pairs 201, 202 are respectively arranged in the housing 210, which differential contact pairs are enclosed by L-shaped shielding plates 203. The distance of adjacent differential contact elements 201, 202, which for the sake of simplicity are also designated in FIG. 10 in a continuous manner with letters a), b) . . . k), l), is l1 and the distance of adjacent contact groups in one column 220 and 221 is l2. The distance of adjacent contact groups of adjacent columns, i.e. the distance of each contact group in column 220 from an adjacent contact group in the column 221, is l3, with l3 substantially corresponding to l2/2, with l3=l2/2 therefore applying. In addition to an improved data transmission quality by further miniaturization, this offset arrangement also provides an increase in the stability in such a way that the reinforcing ribs 230 are respectively arranged in the male multipoint connector in the region of offset columns 221 and 220. As was already explained above, they engage into the cavities 130 of the female multipoint connector formed by offset arrangement as already explained above.

Figure 11:
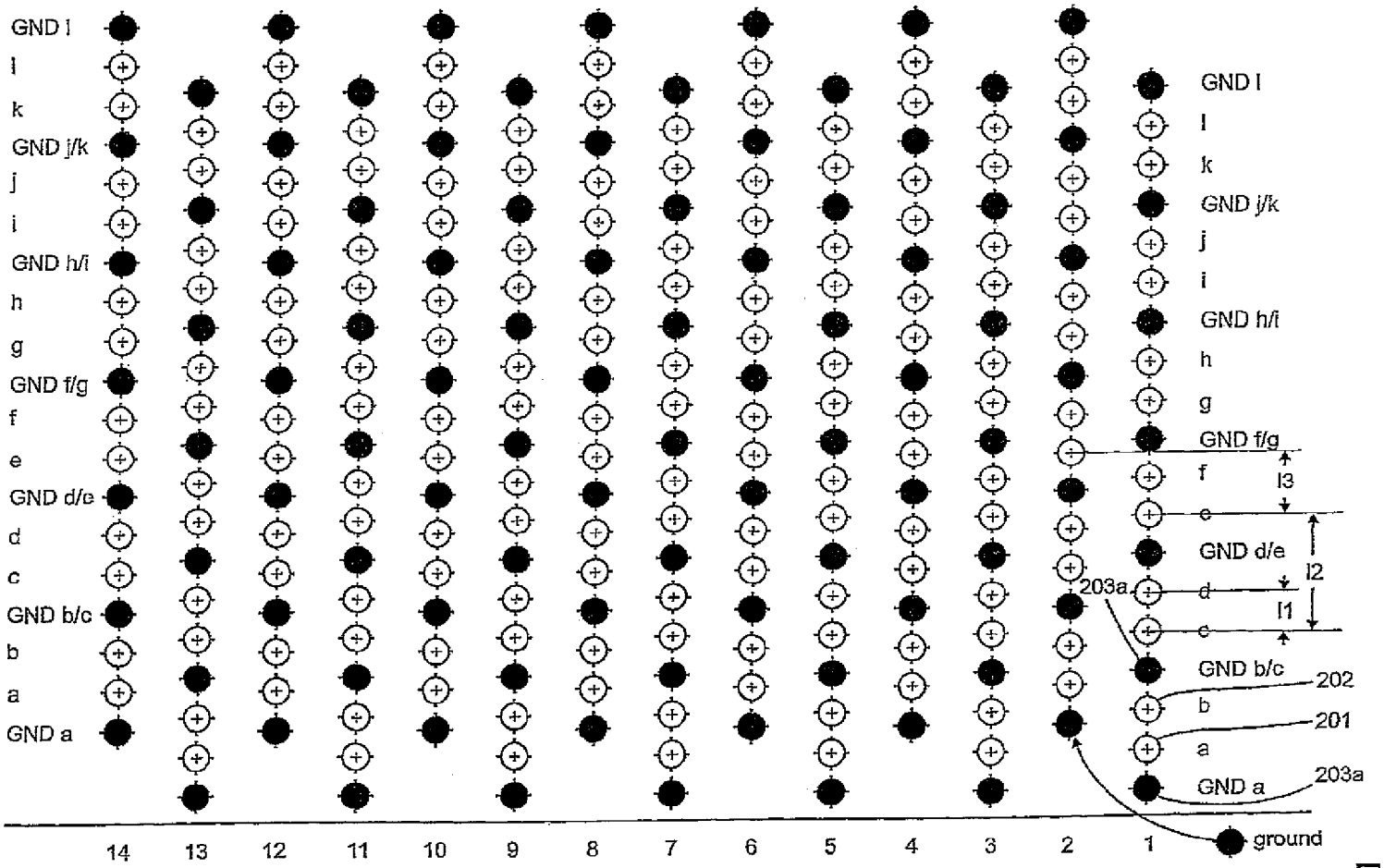
FIG. 11 shows the arrangement (layout) of the pairs of differential contacts and the ground contacts of a male multi point connector in accordance with the invention.

FIG. 11 shows the arrangement or the layout of differential contact pairs 201, 202 and the shielding contact elements 203*a* in a male multipoint connector. This illustration also shows that the distance of adjacent contact elements is l1 and adjacent columns, which are designated in FIG. 11 with continuing numbers 1 to 14, are respectively offset with respect each other by a distance l3, with l3=l2/2 applying. The distance l2 is the distance of adjacent contact groups in a column. FIG. 11 nicely shows the symmetry of the arrangement of differential contact pairs 201, 202 and shielding (ground) contact elements 203*a* (also see FIG. 8), which only allow the high signal transmission rates and especially the high signal transmission frequencies as confirmed by extensive tests by the applicant.

The invention claimed is:

1. A plug-in connection with shielding comprising:

(a) a male multipoint connector comprising a first male column comprising a first set of male contact groups and a second male column comprising a second set of male contact groups offset from the first set of male contact groups by a predetermined length dimension, each male contact group in the first and second male columns being separated from an adjacent male contact group in the first and second male columns, respectively, by a first distance and comprising a differential contact pair of male signal contacts and an L-shaped shielding element surrounding said male signal contacts; and (b) a female multipoint connector comprising a first female column comprising a first set of female contact groups and a second female column comprising a second set of female contact groups offset from the first set of female contact groups by the predetermined length dimension, each female contact group in the first and second female columns being separated from an adjacent female contact group in the first and second female columns, respectively, by the first distance and comprising a differential contact pair of female signal contacts and an L-shaped shielding element surrounding said female signal contacts;

wherein the predetermined length dimension corresponds to approximately half the first distance.

2. The plug-in connection according to claim 1, wherein the first set of female contact groups are arranged in a first wafer and the second set of female contact groups are arranged in a second wafer adjacent to the first wafer.

3. The plug-in connection according to claim 2, wherein a shielding plate is arranged between the first and second wafers.

4. The plug-in connection according to claim 3, wherein the shielding plate comprises a plurality of bent contact springs on a side of the shielding plate facing insertion openings for the female signal contacts, each bent contact spring tapering into a point and engaging into a respective recess in the second wafer adjusted to the bent contact spring in the first wafer.

5. The plug-in connection according to claim 4, wherein the shielding plate is provided with a thinner configuration in an area of the bent contact spring.

6. The plug-in connection according to claim 5, wherein the thinner configuration of the contact spring is produced by stamping.

7. The plug-in connection according to claim 1, wherein the male signal of the male multipoint connector taper in such a way that a circuit board side distance between male signal contacts of each differential pair of male signal contacts on a circuit board side of the male signal contacts facing a circuit board is slightly smaller than a plug side distance of the male signal contacts of the differential pair of male signal contacts on a plug side of the male signal contacts facing the female multipoint connector.

8. The plug-in connection according to claim 7, wherein tapering of the male signal contacts is produced by stamping of the male signal contacts on the circuit board side.

9. The plug-in connection according to claim 7, wherein the male multipoint connector further comprises a housing having a first set of reinforcing ribs and a second set of reinforcing ribs offset from the first set of reinforcing ribs, wherein the reinforcing ribs are arranged on the housing of the male multipoint connector in a region of the first and second of male contact groups respectively arranged in an offset manner, and wherein the reinforcing ribs engage into cavities of the female multipoint connector.

* * * * *

UNITED STATES PATENT AND TRADEMARK OFFICE

CERTIFICATE OF CORRECTION

PATENT NO. : 8,641,448 B2
APPLICATION NO. : 13/394622
DATED : February 4, 2014
INVENTOR(S) : Lappoehn It is certified that error appears in the above-identified patent and that said Letters Patent is hereby corrected as shown below:

In the Claims:

In particular, in Column 8, line 15 (line 2 of Claim 7) after the word "signal" please insert the word:
-- contacts --.

Signed and Sealed this
Sixth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,641,448 B2
APPLICATION NO. : 13/394622
DATED : February 4, 2014
INVENTOR(S) : Juergen Lappoehn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 61 days.

Signed and Sealed this
Twenty-second Day of September, 2015

Michelle K. Lee

Michelle K. Lee
*Director of the United States Patent and Trademark Office*